US010695686B2

(12) United States Patent
Stubenfoll

(10) Patent No.: US 10,695,686 B2
(45) Date of Patent: Jun. 30, 2020

(54) MECHANICAL SPINNING ROBOT TOY

(71) Applicant: Lenoard J. Stubenfoll, Orland Park, IL (US)

(72) Inventor: Lenoard J. Stubenfoll, Orland Park, IL (US)

(73) Assignee: Innovation First, Inc., Greenville, TX (US)

( * ) Notice: Subject to any disclaimer, the term of this patent is extended or adjusted under 35 U.S.C. 154(b) by 186 days.

(21) Appl. No.: 14/497,266

(22) Filed: Sep. 25, 2014

(65) Prior Publication Data

US 2016/0089613 A1 Mar. 31, 2016

Related U.S. Application Data

(60) Provisional application No. 61/883,542, filed on Sep. 27, 2013.

(51) Int. Cl.

| | |
|---|---|
| ***A63H 1/02*** | (2006.01) |
| ***A63H 33/00*** | (2006.01) |
| ***A63H 31/00*** | (2006.01) |
| ***A63H 1/00*** | (2019.01) |

(52) U.S. Cl.

CPC ..... *A63H 33/002* (2013.01); *A63H 1/00* (2013.01); *A63H 31/00* (2013.01)

(58) Field of Classification Search

CPC ..... A63H 1/00; A63H 1/18; A63H 33/042; A63H 3/16; A63H 11/04; A63H 18/028; A63H 33/002; A63H 31/00; A63F 7/3622

USPC ..... 446/237, 239, 241, 314, 326, 332, 353, 446/358, 359

See application file for complete search history.

(56) References Cited

U.S. PATENT DOCUMENTS

| | | | | |
|---|---|---|---|---|
| 1,996,722 A * | 4/1935 | Gilbert | A63H 33/12 | 411/360 |
| 2,426,326 A * | 8/1947 | Cole | A63H 33/108 | 29/451 |
| 2,633,664 A * | 4/1953 | Neilson | A63H 1/18 | 446/257 |
| 3,193,293 A * | 7/1965 | Schaper | A63F 3/00261 | 273/153 R |
| 3,195,266 A * | 7/1965 | Onanian | A63H 33/101 | 174/138 D |
| 3,233,358 A * | 2/1966 | Dehm | A63H 33/042 | 446/102 |

(Continued)

*Primary Examiner* — Joseph B Baldori

(74) *Attorney, Agent, or Firm* — Adam K. Sacharoff; Much Shelist, P.C.

(57) ABSTRACT

A mechanical spinning robot toy includes a top section and a bottom exposed outer gear section. The top section resembles a robot possibly including a head portion and a body portion which may be integral. Any of a variety of arm-like appendages extends outward from the body. The spinning drive mechanism is within the top section. The bottom section has teeth or cogs capable of meshing with another gear or a rack on any of a variety of accessories to move the robot along a track or to animate the accessories. A lower weighted convex surface portion in the bottom biases the robot upright and facilitates spinning of the robot upright. The top and bottom sections are frictionally fit together to rotate or spin together and to spin separately with respect to each when either the top or bottom sections are not allowed to spin.

9 Claims, 10 Drawing Sheets

(56) References Cited

U.S. PATENT DOCUMENTS 3,236,004 A * 2/1966 Christiansen ..... A63H 33/042 384/420
3,415,007 A * 12/1968 Howe ..... A63H 33/042 446/102
3,449,859 A * 6/1969 Neilson ..... A63H 1/18 446/257
3,475,849 A * 11/1969 Fischer ..... A63H 33/042 446/102
3,553,885 A * 1/1971 Tazaki ..... A63H 17/25 446/279
3,568,361 A * 3/1971 Bart ..... A63H 13/00 446/134
3,638,352 A * 2/1972 Christiansen ..... A63H 33/042 301/112
3,680,252 A * 8/1972 Feltman ..... A63H 33/40 446/199
3,728,815 A * 4/1973 Tomiyama ..... A63H 11/10 446/291
3,881,274 A * 5/1975 Kanda ..... A63H 33/00 434/401
3,948,520 A * 4/1976 Barlow ..... A63F 9/14 446/446
3,961,440 A * 6/1976 Saito ..... A63H 13/06 185/39
4,109,398 A * 8/1978 Hida ..... A63H 31/00 434/370
4,165,579 A * 8/1979 Chase ..... A63H 3/52 40/415
4,176,493 A * 12/1979 Dideriksen ..... A63H 33/042 446/102
4,213,266 A * 7/1980 Hyland ..... A63H 15/08 446/431
4,217,724 A * 8/1980 Schoenfield ..... A63H 17/002 273/160
4,222,195 A * 9/1980 Kurosawa ..... A63H 11/10 246/415 A
4,406,231 A * 9/1983 Crimaldi ..... A63H 18/14 104/167
4,484,407 A * 11/1984 Petersson ..... A63H 33/102 403/292
4,599,077 A * 7/1986 Vuillard ..... A63H 17/002 446/124
4,609,363 A 9/1986 Udagawa et al.
4,623,318 A * 11/1986 Tsiknopoulos ..... A63H 3/48 446/219
4,664,640 A * 5/1987 Shindo ..... A63H 33/006 446/227
4,695,262 A * 9/1987 Crosby ..... A63H 1/00 446/236
4,705,487 A 11/1987 Ishimoto
4,723,931 A * 2/1988 Allen ..... A63H 3/16 446/268
4,732,049 A * 3/1988 Beny ..... A63H 29/22 446/156
4,736,826 A 4/1988 White et al.
4,772,241 A * 9/1988 Bro ..... A63H 1/20 446/202
4,867,728 A * 9/1989 Moomaw ..... A63H 29/24 446/257
4,998,903 A * 3/1991 Bolli ..... A63H 31/10 446/102
5,026,057 A * 6/1991 Watford ..... A63H 13/06 273/108
5,094,643 A * 3/1992 Bolli ..... A63H 33/04 403/348
5,100,142 A * 3/1992 Cannata ..... A63F 9/0819 273/153 S
5,360,364 A * 11/1994 Poulsen ..... A63H 33/042 403/57
D353,633 S * 12/1994 Nonaka ..... D21/461
5,411,428 A * 5/1995 Orii ..... A63H 33/086 446/102
5,458,523 A * 10/1995 Aoki ..... A63H 13/06 273/440.1
5,525,086 A * 6/1996 Gentile ..... A63H 27/14 446/234
5,577,448 A * 11/1996 Leung ..... A47G 33/0809 104/125
5,755,608 A * 5/1998 Glickman ..... A63H 1/00 446/256
5,779,515 A * 7/1998 Chung ..... A63H 33/04 446/102
5,823,845 A * 10/1998 O'Berrigan ..... A63H 1/20 446/234
5,827,106 A * 10/1998 Crepeau ..... A63H 33/425 446/102
5,890,945 A * 4/1999 Asami ..... A63H 18/04 446/228
5,919,072 A * 7/1999 Pohlman ..... A63H 17/002 446/120
6,030,270 A * 2/2000 Krog ..... A63H 33/042 446/102
6,276,985 B1 * 8/2001 Kober ..... A63H 11/14 180/187
6,322,415 B1 * 11/2001 Cyrus ..... A63H 18/14 446/130
6,408,984 B1 * 6/2002 Cavagnaro ..... E06C 7/44 182/205
6,419,544 B1 7/2002 Parker et al.
6,439,955 B1 * 8/2002 Feketo ..... A63H 17/00 446/121
6,530,817 B1 * 3/2003 Winslow ..... A63H 1/00 446/256
6,561,866 B1 * 5/2003 Lee ..... A63H 33/06 446/103
6,582,273 B2 * 6/2003 Chen ..... A63H 5/00 446/175
6,595,825 B1 * 7/2003 De Wilde ..... A63H 33/067 403/348
6,638,135 B2 * 10/2003 Fong ..... G09F 19/08 40/430
6,645,030 B2 * 11/2003 Coleman ..... A23G 3/28 426/104
6,739,939 B2 * 5/2004 Matsukawa ..... A63F 3/00895 446/256
6,773,323 B1 * 8/2004 Huang ..... A63H 31/00 446/103
6,893,316 B2 * 5/2005 Maxwell ..... A63H 33/042 446/103
6,896,078 B2 5/2005 Wakui
7,056,185 B1 * 6/2006 Anagnostou ..... A63H 17/262 180/167
7,131,887 B2 11/2006 Hornsby et al.
7,458,876 B2 12/2008 Laurienzo et al.
7,726,422 B2 6/2010 Sun et al.
7,740,518 B2 * 6/2010 Elliott ..... A63F 9/16 273/126 R
7,927,170 B2 4/2011 Bickerton et al.
8,128,454 B2 * 3/2012 Rosenblum ..... A63H 17/008 446/236
8,205,368 B2 * 6/2012 Banman ..... G09F 19/08 40/493
2002/0065016 A1 * 5/2002 Huang ..... A63H 33/042 446/103
2003/0087582 A1 * 5/2003 Chen ..... A63H 5/00 446/175
2003/0096555 A1 * 5/2003 Fong ..... A63H 13/20 446/236
2005/0040598 A1 * 2/2005 Wilk ..... A63F 3/00697 273/288
2005/0233674 A1 * 10/2005 Torres ..... A63H 1/02 446/236
2007/0259600 A1 * 11/2007 Bedford ..... A63H 21/04 446/444

(56) References Cited

U.S. PATENT DOCUMENTS

| | | | | |
|---|---|---|---|---|
| 2008/0160873 | A1* | 7/2008 | Yoneda | A63H 11/18<br>446/86 |
| 2011/0111672 | A1* | 5/2011 | Miyake | A63H 17/02<br>446/378 |
| 2012/0090356 | A1* | 4/2012 | Liberman | A44C 9/003<br>63/3 |

* cited by examiner

MECHANICAL SPINNING ROBOT TOY

RELATED APPLICATION

This application is based on, and claims the benefit of, U.S. Provisional Application No. 61/883,542 filed Sep. 27, 2013.

BACKGROUND OF THE INVENTION

The present invention relates to robot toys and more particularly to a mechanical spinning robot toy that interacts with other robot toys and accessories.

Children have enjoyed spinning tops for centuries. Spinning tops operate typically with a string round around the top and throwing the top to the floor resulting in the top spinning on its apex or tip in a gyroscopic entertaining manner. Multiple tops may be played with at one time as children enjoy watching them bump violently together and in multiple environments.

Robot toys have become popular the last century as they animate humans and have multiple functionalities including but not limited to walking, fighting, noise making, utilizing weapons and vehicles and may have working appendages.

There is a need and desire in the toy market for a small robot that is mechanical and moves about that also spins and may be connected to drive additional accessories all to entertain children.

SUMMARY OF THE INVENTION

A principal object and advantage of the present invention is that the robot spins around wildly like a top causing great excitement in children.

Another object and advantage of the present invention is that the robot is simple in construction with an optional spinning top and spinning bottom sections while yet performing many functions in its spinning operations.

Another object and advantage of the present invention is that the appendages are functional in that they may carry objects, hold onto accessories to permit the bottom gear section to mesh with an accessory causing any of a variety of animations between the robot and the accessory.

Another object and advantage of the present invention is that the spinning motion is reversible to assist in up righting the robot if it is knocked over.

Another object and advantage of the present invention is that the appendages may include a clamp to hold the robot onto a gear track or rack.

Another object and advantage of the present invention is that the robot maybe driven by a battery operated motor with switches or remote control while also capable of being driven by a string, pull cord, flywheel or the like.

Another object and advantage of the present invention is that the bottom section external gear may drive all sorts of vehicles or move the robot along a gear track course.

DETAILED DESCRIPTION

Figure 1:
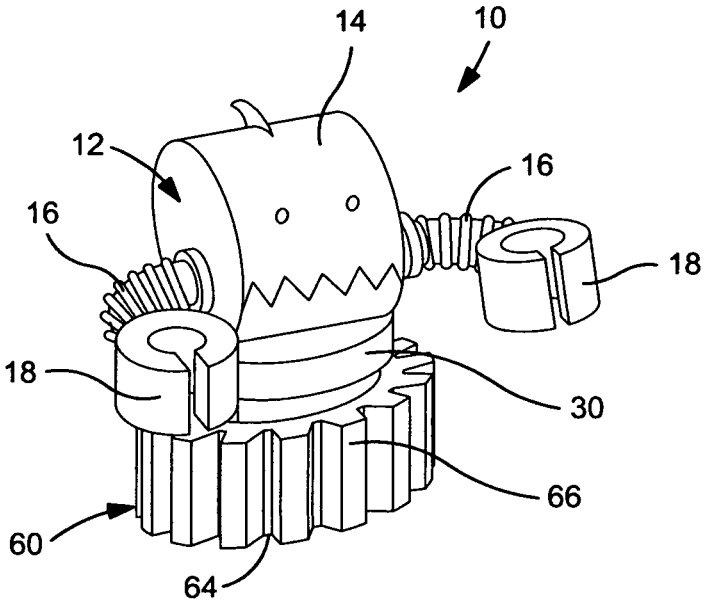
FIG. 1 is a perspective view of the mechanical spinning robot toy of the present invention.

Referring to FIGS. 1 through 4, the mechanical spinning robot toy 10 may be understood and appreciated. The robot toy 10 generally comprises a top section 12 and a bottom section 60 that are held together by an axle 50 in a low friction manner. A battery operated motor is located in the top section 12 and is connected to the bottom section 60 in numerous ways that freely rotate on the axle 50. With the motor engaged, the bottom section spins very fast like a top. The top section 12 follows the bottom section when not held stationary. When the bottom section 60 is held stationary, the top section spins alone in a very fast motion.

Figure 2:
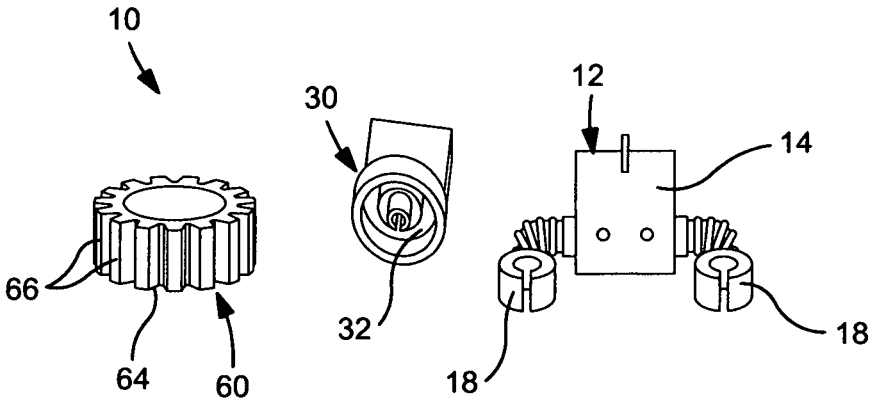
FIG. 2 is a disassembled view of the toy.

The top section 12 preferably has a head portion 14 and body portion 30. Appendages or arms 16 with gripping hands 18 extend outwardly from the head 14 or body 30 and are capable of performing many functions as will be appreciated here with further reading. If desired, appendages 16 may be fixed, interchangeable, or spring loaded for detachment. Body portion 30 may be integral with head 14. Body 30 may also be separate and attachable with all or a portion of head 14 as illustrated in FIGS. 1 and 2.

Within body 30 is a raised floor 32 upon which is mounted a motor 34 with a small shaft gear 36 protruding through the floor 32. A battery 38 is also located within the body 30. The motor 34 may be engaged with a switch on the toy or a RF or IF remote control. The motor 34 is also readily reversible for special action effects of the robot toy 10, such as tipping or uprighting the toy robot 10.

Below the raised floor is a large drive gear 42 upon which the top section 12 may rest. Gear 42 is driven by engagement with motor gear 36. How this large gear 42 imports rotational movement to the robot toy may be done in various ways. The top section 12 and large gear 42 are rotatably mounted on axle 50. More specifically, a notched or sectioned collar 46 somewhat semicircular in shape shares a central aperture 48 with large gear 42. A retainer 52 may be used to retain axle 50 within the top section 12.

Figure 3:
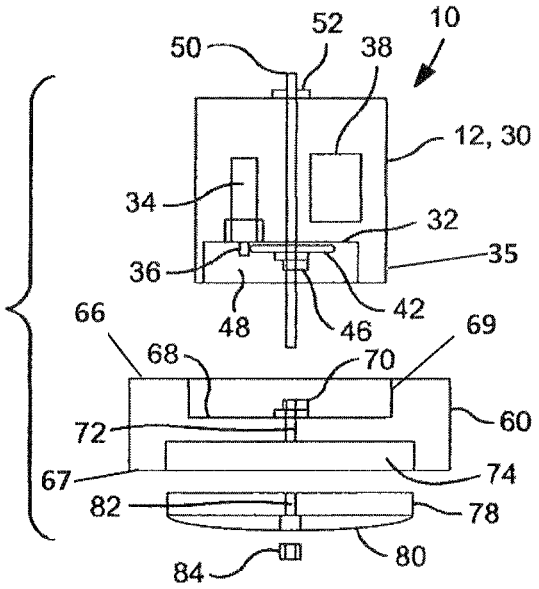
FIG. 3 is a schematic exploded view showing internal components of the toy.
Figure 3A:
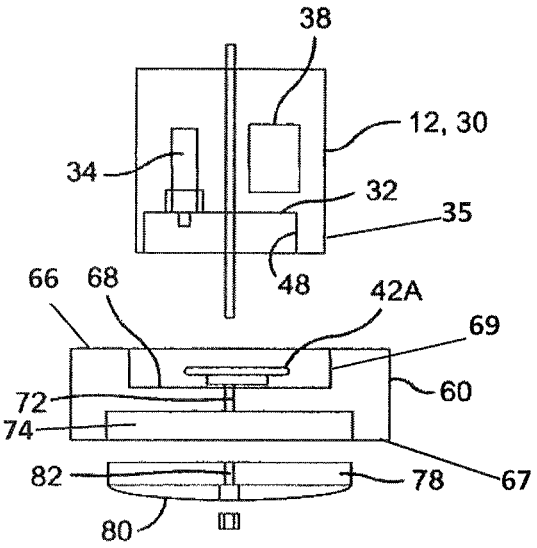
FIG. 3A is a schematic exploded view showing internal components of another embodiment similar to FIG. 3 with the toy drive large gear on the external gear bottom section.
Figure 4:
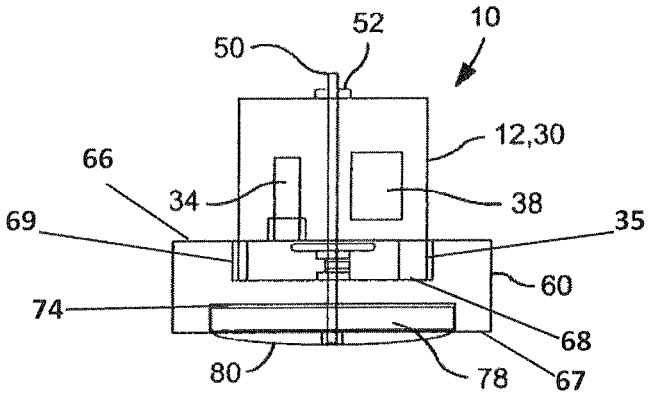
FIG. 4 is a schematic view showing internal components of the assembled toy.

Continuing to refer to FIGS. 3, 3A, and 4, the bottom section 60 has an external or exposed gear 64 with teeth or clogs 66. The bottom section includes a topside a topside 66 configured to face towards the body 30 and the bottom section 60 includes a bottom side 67 configured to face towards a play surface. Within gear 64 may be a channel 69 and a central floor 68 facing towards the body 30 in the topside 66 of the bottom section 60. The central floor 68 has a centrally located fixed notched post 70 which shares a central aperture 72 with gear 64. A bottom most recess 74 in the bottom side 67 permits the mounting therein of a weighted convex spinning contact portion 78 with a convex surface 80 which facilitates the spinning of the robot toy 10 in a gyroscopic manner and assists in keeping the toy 10 upright. This floor contact portion has a central aperture 82 to receive axle 50 about which the top and bottom sections 12 and 60 are secured loosely together with locking nut 84. It is important that top and bottom sections 12 and 60 are loosely held together with minimum friction for the top and bottom sections 12 and 60 to spin together and separately without putting any excessive loads on the motor 34 and battery 38.

FIG. 3A illustrates that large gear 42A may be flipped over and molded, formed or secured to internal floor 68 of the bottom section 60. Thus if the bottom section 60 is held steady, the top section 12 will spin around large gears 42 or 42A. Otherwise, top section 12 will simply follow bottom section 60 in its spinning motion simply by top section 12 resting on large gear 42. If the top section 12 is held in place, the bottom section 60 will spin independent of the top section 12.

Figure 5:
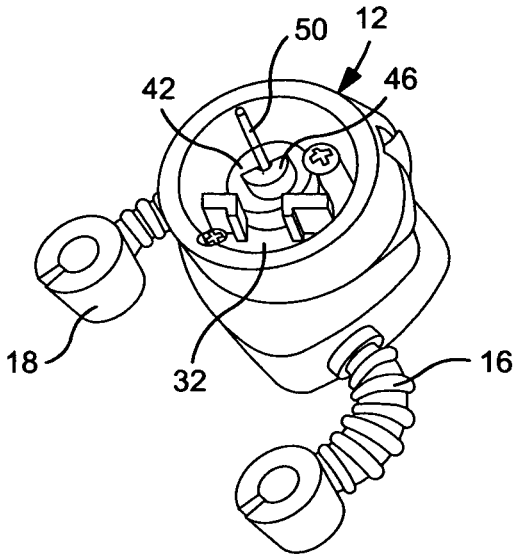
FIG. 5 is a perspective view into the bottom of the top section of the toy.
Figure 6:
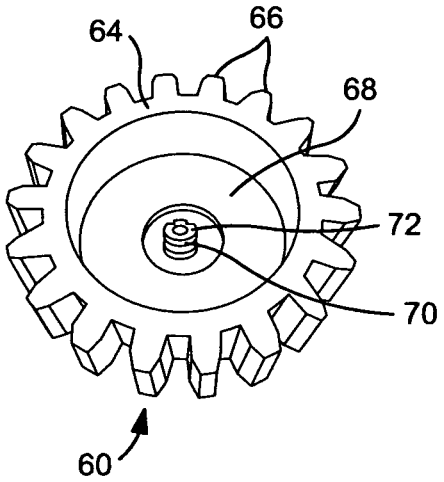
FIG. 6 is a perspective view into the top of the lower section drive gear showing the notched post.
Figure 5A:
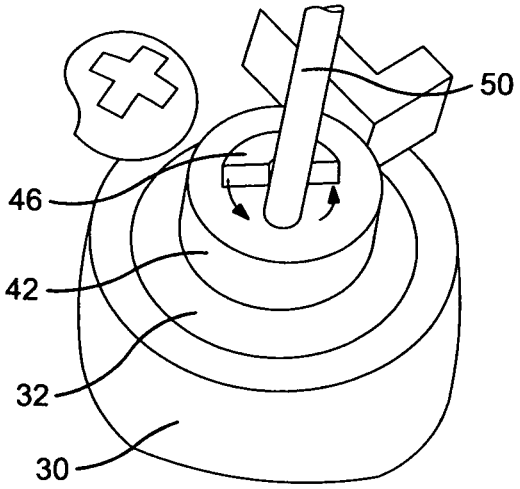
FIG. 5A is an enlarged view of FIG. 5 showing the rotatable notched collar on the axle.
Figure 6A:
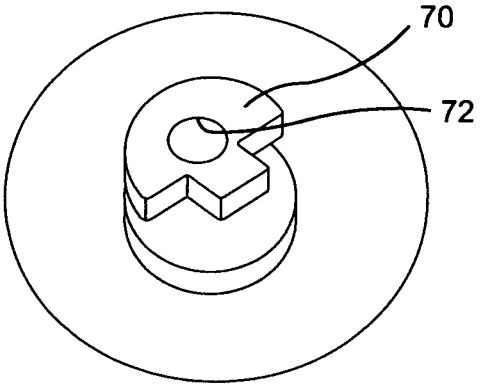
FIG. 6A is an enlarged view of the notched post.

FIGS. 5 through 6A more clearly illustrate the coupling between notched or flat-faced collar 46 about nonspinning stationary axle 50 with the notched post 70 secured in the bottom section 60. Notched collar 46 rotates around axle 50 driven by motor 34. Notched post 70 rotates in a fitting in bottom section 60. Engagement between notched collar 46 and notched post 70 drives lower external gear 64.

Figure 7:
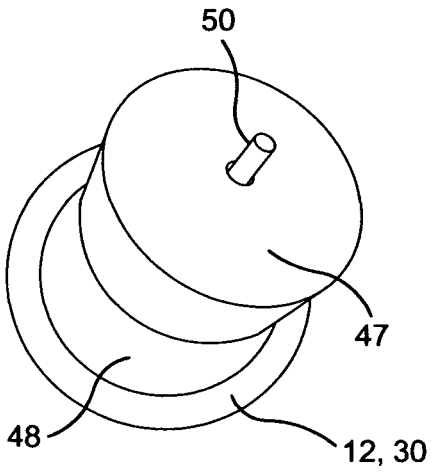
FIG. 7 is a perspective view into another embodiment of the bottom of the top section of the toy showing the rotatable flat collar about the axle.
Figure 8:
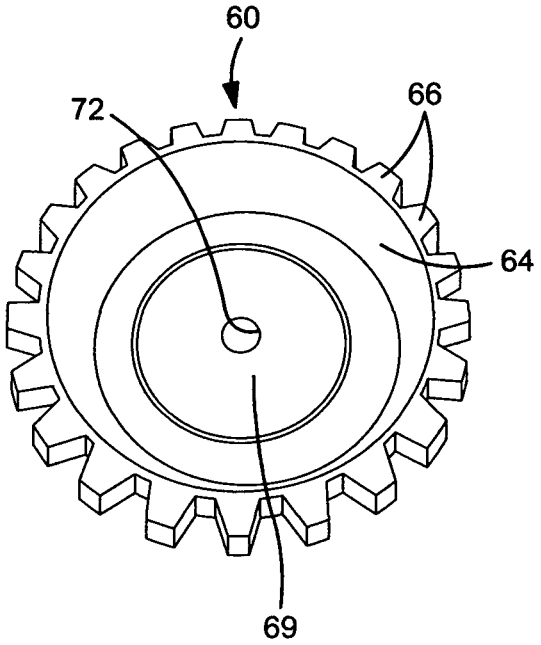
FIG. 8 is a perspective view into the top of the lower section drive gear of the embodiment shown in FIG. 7 showing the flat floor or top of the weighted portion for frictional engagement with the flat collar.

FIGS. 7 and 8 illustrate another means to functionally connect and drive the top and bottom sections 12 and 60. A flat rotatable collar 47 to be driven by gears 36 and 42 (or the like) around stationary axle 50 makes a frictional driving contact with smooth internal floor 69.

Figure 9:
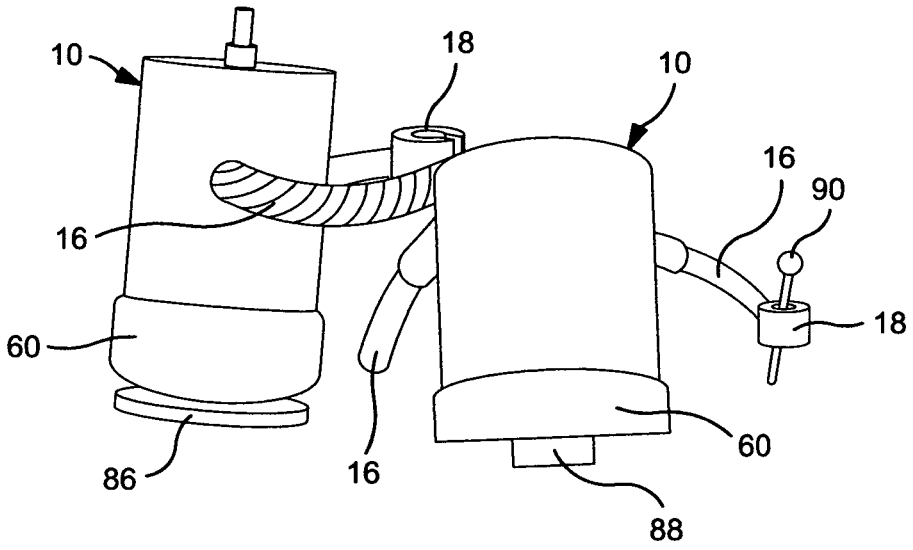
FIG. 9 is a perspective view illustrating two mechanical spinning robot toys spinning and fighting each other with their extending arms.
Figure 10:
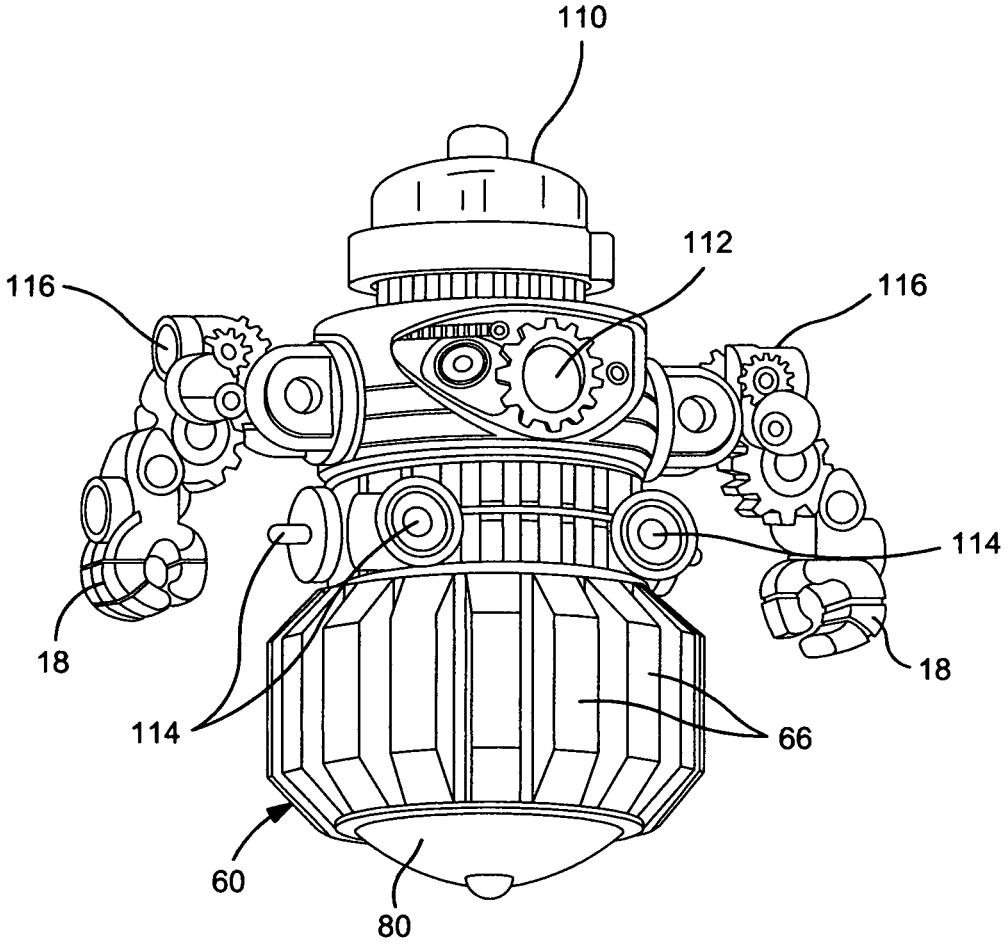
FIG. 10 is an artistic sketch of a production robot toy with optional appendages that may be interchangeable and spring loaded.

FIG. 9 illustrates two robot toys 10 fighting, preferably in a confined area. The floor could actually be sloped centrally to encourage contact. As illustrated, one of the toys has a larger diameter more stable bottom 86, while the other has a smaller diameter less stable bottom 88. As the toys 10 are spun in clockwise and counter clockwise motions under control of children suitably by remote control, their arms 16 and hands or fists 18 violently contact one another. Eventually one robot toy 10 may knock over the other robot toy 10 and win the fight. Spinning and reversing the downed robot toy 10 will eventually upright the toy to its desired stable spinning condition. As an enhancement of a battle motif, a robot toy of the present invention may be provided with a weapon 90 gripped in its hand 18 as it spins about. Determination of the victor may also result from the flailing of the robot toy's arms, or gripped weapons, striking an exposed on/off switch 112 to shut down the opponent 110 or striking a trigger 114 to cause detachment of a spring loaded appendage 116 as illustrated in FIG. 10.

Figure 11:
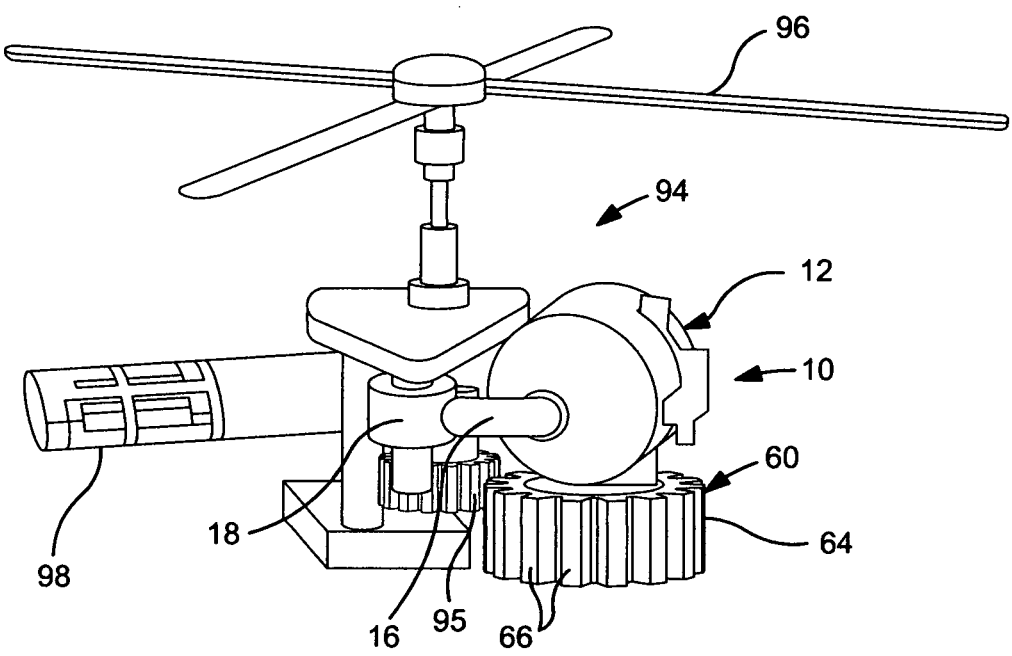
FIG. 11 is a perspective view of the robot toy's arms connected to a helicopter gun ship while the lower section large exposed gear drives the operation of the gun ship's weapon and spinning blades.

FIG. 11 illustrates a robot toy 10 connected to a helicopter gun ship 94. The hands 18 are secured to the gun ship 94 in a gripping manner similar to attachment of a weapon. The exposed gear 64 is thereby held in place and meshing with a gear 95 on the gun ship 94 which is further meshed in a gear train to the spinning overhead blades 96 and rotating machine gun 98. The exposed gear 64 also moves the ship 94 about.

Figure 12:
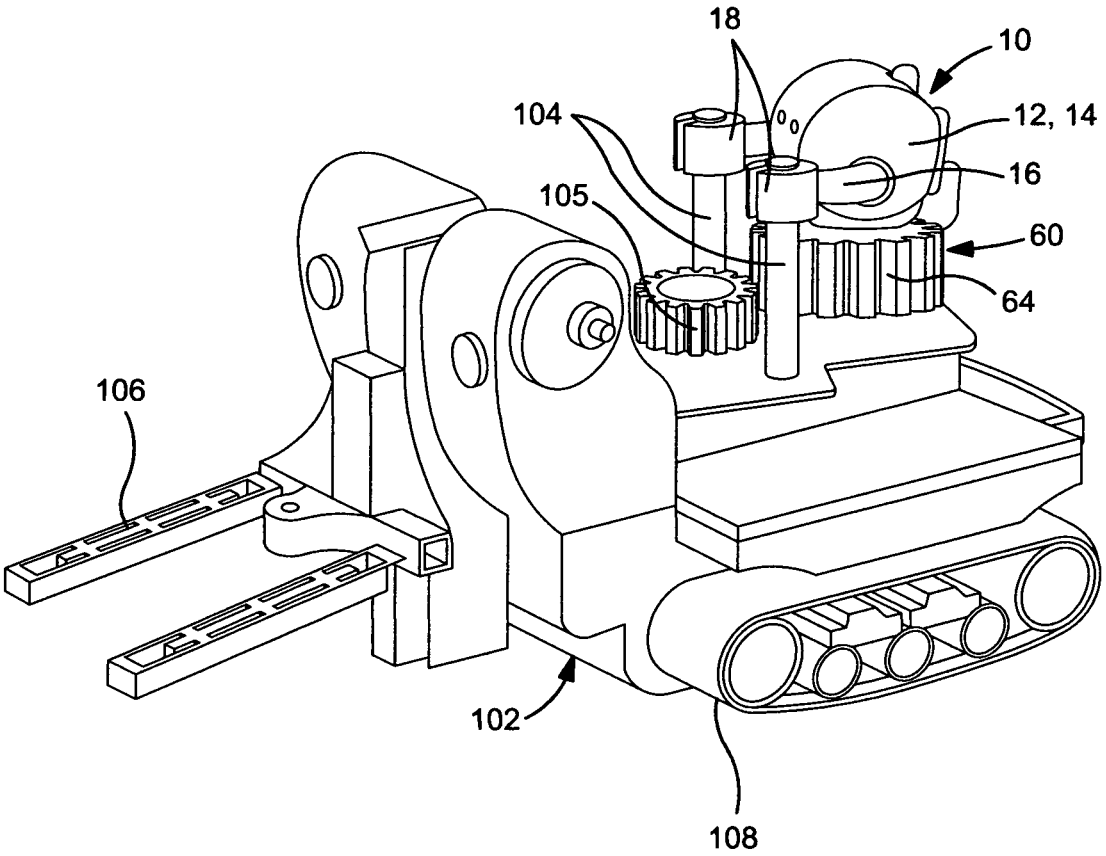
FIG. 12 is a perspective view of the robot toy's arms connected to a fork lift vehicle while the lower section large exposed gear drives the operation of the vehicle and fork.

FIG. 12 illustrates a robot toy 10 is placed on top and connected to a fork lift vehicle 102 by hands 18 being secured to operation-like levers 104. The exposed gear 64 is thereby held in place and meshing with a gear 105 on the fork lift 102 which is further meshed in a gear train to operate the lifting forks 106 and drive tracks 108.

Figure 13:
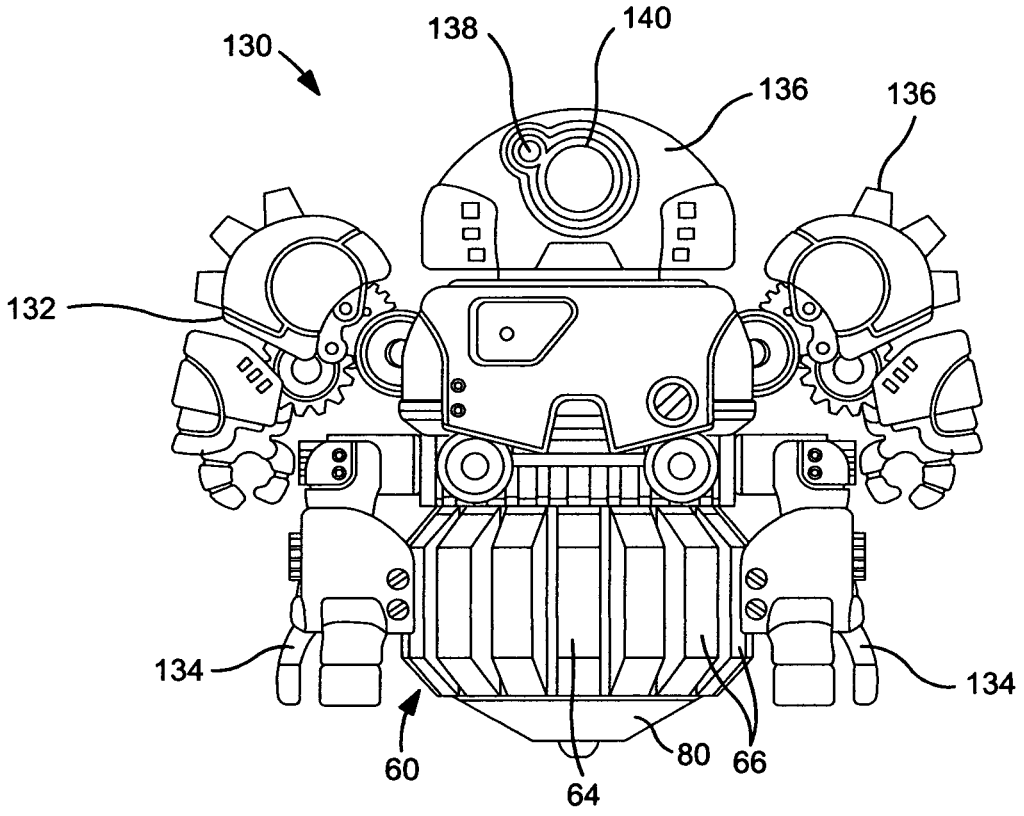
FIG. 13 is an artistic sketch of a production robot toy with optional appendages and track clamps that may be interchangeable and spring loaded along with optional accessories and armor.

FIG. 13 is an artistic sketch of a production robot toy 130 with articulable upper appendages 132 and lower track clamps 134 that may be interchangeable and spring loaded. Track clamps 134, as shown in FIG. 13, are attached to robot toy 130 above lower section external gear 64 and extend down outboard of teeth 66. Robot toy 130 is also provided with optional accessories including weapons and armor 136, LEDs 138 and a speaker 140.

Figure 14:
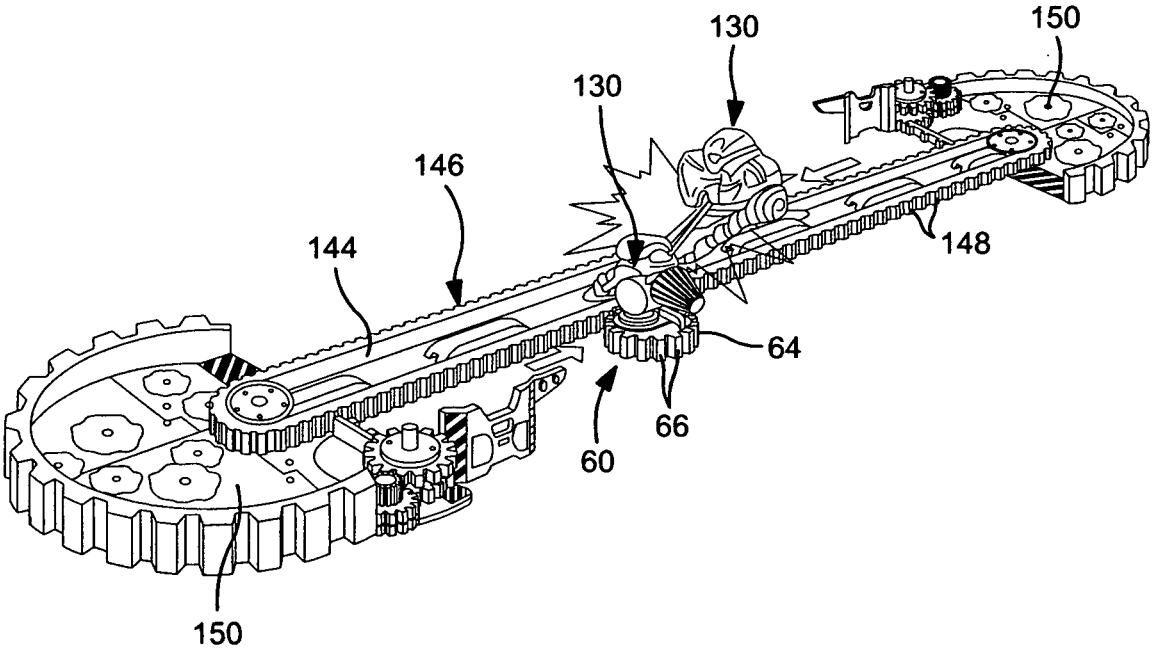
FIG. 14 is an artistic sketch of a production robot toy with track clamps that are secured to a track that is engaged with the large exposed gear to drive the robot toy around the track.

FIG. 14 is an artistic sketch of robot toys 130 with track clamps 134 that are secured to slide along one side 144 of a geared track 146 with teeth 148 on the other side. Teeth 66 of the large exposed gear 64 engage teeth 148 of the track to drive the robot toys 130 around the track 146. As illustrated the robot toys 130 may do battle, or joust, in a manner similar to that described with respect to the embodiment of FIG. 9. Alternatively, even a single robot toy may race around a fixed or flexible track with large exposed gear 64 engaging teeth on the outside or inside of a track. Semicircular end pieces 150 guide the robot toy to turn around one hundred eighty degrees and go in the opposite direction.

The above embodiments are for illustrative purposes. The actual scope of the invention is defined by the following claims.

What is claimed:

1. A mechanical spinning toy and a separate accessory used in combination with each other, comprising:

a mechanical spinning toy comprising:

a top section having a body;

a bottom section including a first externally exposed gear that rotates with the bottom section for driving the accessory, and the bottom section having a topside configured to face towards the top section and the bottom section having a bottom side configured to face towards a play surface, and wherein within the topside is an aperture with a central floor sized to receive a lower portion of the body and wherein the bottom side includes a bottom recess;

a bottom convex spinning contact portion being positioned within the bottom recess of the bottom side and further configured for contact with the play surface;

a single axle having a top end and a bottom end, the single axle passing through the top and bottom sections such that the top and bottom ends are positioned externally to the top and bottom sections respectively, and the single axle, when rotating, is further configured to cause the top and bottom sections to spin when the single axle is rotating when;

a motor and a battery power source for operating the motor carried within one of the top section or the bottom section, and the motor in communication with a gear internal to the top section or bottom section and configured to rotate the single axle;

the top and bottom sections being configured in minimum frictional engagement with each other by the single axle such that the minimum frictional engagement causes both the top section and bottom section to rotate together when the single axle is rotating and further causes either the top section or bottom section to spin independently when spin in one of either the top section of bottom section is prevented;

a top retainer and a bottom retainer separately secured onto the top and bottom ends defined on the single axle;

a separate accessory comprising: a second externally exposed gear configured to mesh with the first externally exposed gear of the bottom section of the toy wherein rotation of the bottom section drives the second externally exposed gear of the accessory.

2. A mechanical spinning toy assembly comprising:

a mechanical spinning toy, comprising:

a) the toy having a top section, and the top section having a body;

b) the toy having a bottom section including a first externally exposed driving gear that rotates with the bottom section, and the bottom section having a topside configured to face towards the top section and the bottom section having a bottom side configured to face towards a play surface, and wherein within the topside is an aperture with a central floor sized to receive a lower portion of the body and wherein the bottom side includes a bottom recess;

a bottom convex spinning play surface contact portion being positioned within the bottom recess of the bottom side and further configured for contact with the play surface;

c) a single axle passing through the top and bottom sections such that the single axle when spinning imparts spin to the top and bottom sections together, and the single axle having top and bottom ends positioned externally to the top and bottom sections respectively;

d) the top and bottom sections being configured in engagement with each other by the single axle and further configured in minimum frictional engagement by the single axle with each other such that the minimum frictional engagement causes both the top section and bottom section to rotate together when the single axle is rotating and further causes either the top section or bottom section to spin independently when spin in one of either the top section of bottom section is prevented;

e) a motor carried in one of the top section or the bottom section;

f) a battery power source for the motor carried in one of the top section or the bottom section; and g) a gear in one of the top section or the bottom section driven by the motor to spin the top and bottom sections together; and h) a top retainer and a bottom retainer separately secured onto the top and bottom ends defined on the axle.

3. The toy assembly of claim 2 further comprising the accessory, in which the first externally exposed gear drives the accessory.

4. The toy assembly of claim 2 further comprising:

a) a track having an edge generally parallel to a playing surface and at least one side generally transverse to the edge and vertically oriented to the playing surface with teeth on the one side vertically oriented with respect to the playing surface; and b) the externally exposed gear having vertically oriented teeth that engage the teeth on the track to drive the toy along the track.

5. The toy assembly of claim 4 further comprising:

a) a clamp secured to the toy; and b) the clamp secures the toy for movement along the track.

6. The toy assembly of claim 5 in which the clamp is disposed above the external exposed gear and depends down outboard of the gear.

7. The toy assembly of claim 4 further comprising:

a) a smooth side of the track generally transverse to the edge and opposite the teeth on the one side of the track;

b) a depending clamp engaging the smooth side of the track for sliding movement along the smooth side of the track opposite the teeth on the track; and c) the clamp securing the toy for movement along the track.

8. The toy assembly of claim 4 further comprising:

a) the track forming an elongated closed loop forming two sides generally transverse to the edge and vertically oriented to the playing surface with the teeth on the exterior of the two sides and the closed loop further having substantially opposed ends; and b) a generally semicircular piece adjacent each end of the elongated loop, wherein each semicircular piece further includes teeth on the exterior configured to guide the toy to turn around one hundred and eighty degrees and go in the opposite direction.

9. The toy assembly of claim 4 further comprising:

a) another track substantially parallel to and spaced from the track with the teeth on the exterior of both tracks; and b) a second mechanical spinning toy similarly configured and having an externally exposed gear having vertically oriented teeth that engage the teeth on the another track to drive the toy along the another track in an opposite direction to the toy when both mechanical spinning toys are placed facing each other and at opposite ends of their respective tracks.

* * * * *